United States Patent [19]

Susanna

[11] Patent Number: 4,925,419

[45] Date of Patent: May 15, 1990

[54] LIFE PRESERVER COLLAR

[75] Inventor: Luigi Susanna, San Dona' Di Piave, Italy

[73] Assignee: Giomama S.r.l., San Dona' Di Piave, Italy

[21] Appl. No.: 282,269

[22] Filed: Dec. 9, 1988

[30] Foreign Application Priority Data

Dec. 28, 1987 [IT] Italy ..... 15904 A/87
Nov. 15, 1988 [IT] Italy ..... 83515 A/88

[51] Int. Cl.[5] ..... B63C 9/08
[52] U.S. Cl. ..... 441/123; 441/88
[58] Field of Search ..... 441/123, 122, 106, 108, 441/80, 81, 88, 90, 92, 93, 94; 272/71

[56] References Cited

U.S. PATENT DOCUMENTS

| | | | |
|---|---|---|---|
| 1,385,581 | 7/1921 | Pallady | 441/123 |
| 1,442,746 | 1/1923 | Timberlane | 441/123 |
| 1,806,786 | 5/1931 | Claus | 441/123 |
| 2,766,466 | 10/1956 | Johns | 441/123 |
| 3,119,132 | 1/1964 | Nayar | 441/96 |
| 3,321,785 | 5/1967 | Soubiran | 441/96 |
| 3,633,230 | 1/1972 | Horton | 441/123 |

FOREIGN PATENT DOCUMENTS

| | | | |
|---|---|---|---|
| 135858 | 2/1901 | Fed. Rep. of Germany . | |
| 788421 | 10/1935 | France . | |
| 84101 | 1/1987 | Italy . | |
| 6413120 | 5/1966 | Netherlands | 441/123 |
| 2130972 | 6/1984 | United Kingdom . | |

*Primary Examiner*—Joseph F. Peters, Jr.
*Assistant Examiner*—Clifford T. Bartz
*Attorney, Agent, or Firm*—Wegner & Bretschneider

[57] ABSTRACT

Life preserver collar for use in preventing drowning and to be worn by an individual around the neck, the collar (10) being provided with means to deliver fluid under pressure and with expansible envelope means and consisting of two identical elements (11) connected together as an extension of each other to form the collar (10), the elements (11) being separable from each other at least at a reciprocal joint so as to enable the collar (10) to be put about the neck of the user, each element (11) comprising a container (13) of an expansible envelope (20) and a container (12) of fluid.

21 Claims, 5 Drawing Sheets

LIFE PRESERVER COLLAR

The invention concerns a life preserver collar. To be more exact, the invention concerns a collar to be put about the neck of an individual, the collar being provided with means able to expand in the event of an emergency involving the danger of drowning.

Life preserver means are known which are fitted to the arms or are worn or are put about the waist, such as those indicated in DE No. 135.858 for instance.

The known means entail many drawbacks. The rings to be fitted to the arms are not only ugly and uncomfortable to wear but also do not protect the head, so that anyone who wears them runs the risk of drowning just the same by swallowing too much water.

The lifebelts to be put about the waist involve the same shortcomings.

The life jackets to be worn offer the advantage of being safe but the drawbacks of being bulky, irksome to wear and ugly.

FR No. 788.421 discloses a life jacket with a watertight container which can be inflated by actuating a pressurized container of a gas. This jacket is suitable to be worn but entails drawbacks due to the whole procedure for putting it on before use.

U.S. Pat. No. 3,119,132 discloses a lifebelt comprising two watertight containers which can be inflated by actuating a container of gas under pressure. This lifebelt entails the same drawbacks as DE No. 135.858, including a centre of gravity unsatisfactory for its user.

U.S. Pat. No. 3,21,785 discloses a collar with two watertight containers which can be inflated by actuating two containers of gas under pressure. This disclosure includes a collar which is hard to wear and has protruding parts that are easily broken and dangerous for the user. Moreover, the means to actuate the containers of gas under pressure are unreliable and hard to operate.

U.S. Pat. No. 3,633,230 discloses a collar with a watertight container which can be inflated by actuating a container of gas under pressure. This teaching entails, first of all, less safety since there is only one watertight container and one container of gas; moreover, the system for actuation of the gas container is not workable. Furthermore, the system for putting on and securing the collar is not safe and is hard to use in the event of panic or an emergency. Besides, the structure of the collar is fragile and readily breakable.

GB No. 2,130,972 discloses a harness which also enfolds the neck and comprises one single chamber and one single container of gas under pressure. Besides being hard to put on in the event of panic or an emergency, it includes only one chamber and one container of gas. Moreover, the actuation system provides for the operation of cords or ropes, which are not only dangerous in the event of panic or an emergency but are also hard to locate and actuate.

IT No. 84101 A/87 discloses a collar with two containers of a gas under pressure, which, when actuated, cause inflation of two watertight vessels. The general idea is good but not developed nor capable of being embodied. It is not clear how the actuation mechanism works, how the collar is secured or how it can be put on and how the vessels are secured. More generally, it discloses an idea but not something which can be applied on an industrial scale.

The present applicant has designed, tested and embodied this invention to overcome the above drawbacks.

According to the invention the collar consists of two symmetrically identical elements which are secured to each other in a stable manner but can also be readily separated so as to be put on or to be inspected or to undergo regular or extraordinary maintenance.

The invention provides for each element to be independent and to include means to deliver fluid under pressure and expansible watertight container means to provide support.

Cooperation between the two elements arranges that each element forms a fixed point for actuation of the delivery means of the other element.

In the event of an emergency the collar is put on and pulled with one hand, on the front of the body for instance; the delivery means are thus actuated and release the fluid under pressure, which thus expands within the expansible watertight container means providing support.

These expansible support means expand and press on the neck protectors, releasing them from their anchorages and creating the bubbles of fluid which provide support for an individual in the water.

According to the invention at least two bags or bubbles are created, at least one of them per element.

The invention is therefore embodied with a life preserver collar according to the contents and features of the main claim and of one or another of the dependent claims.

The attached figures, which are given as a non-restrictive example, show the following:

FIG. 1 gives a view from above of a collar according to the invention;

In the figures a collar 10 comprises in this example two substantially equal elements 11.

Figure 1:
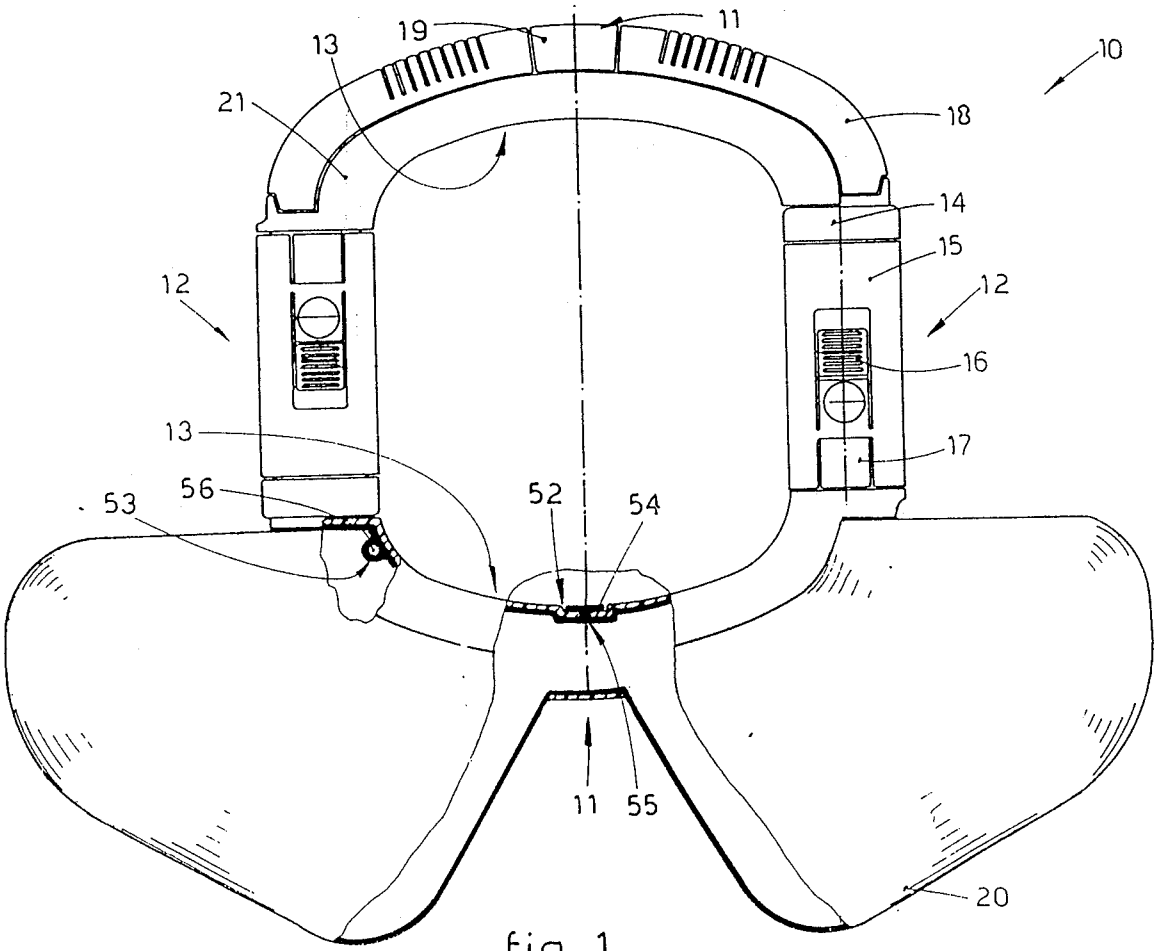
Figure 2:
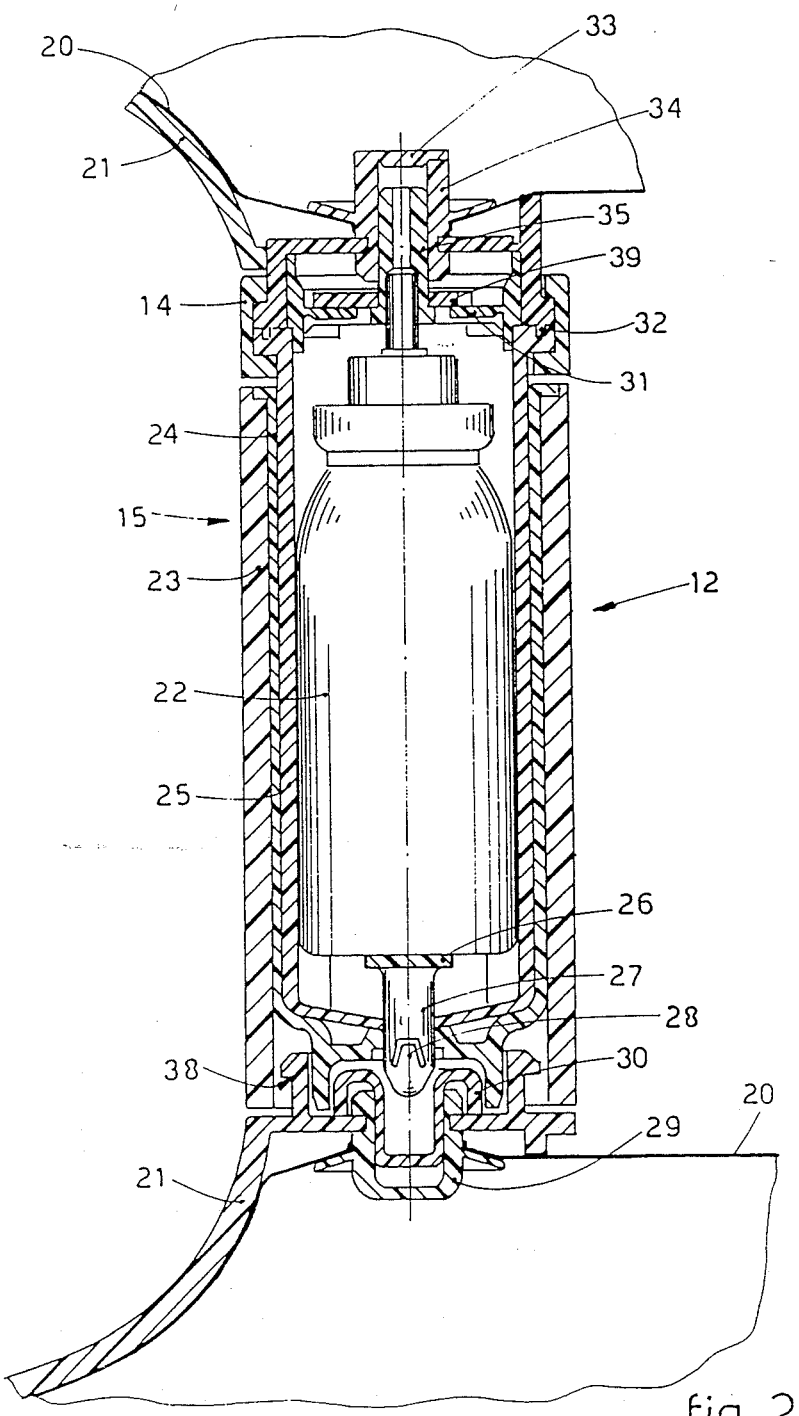
FIG. 2 shows a horizontal section of the distribution means of FIG. 1.

In the example of FIG. 1 the elements 11 can be separated from each other to assist putting on of the collar and, when located about the neck of the user, are fixed together again.

Figure 4:
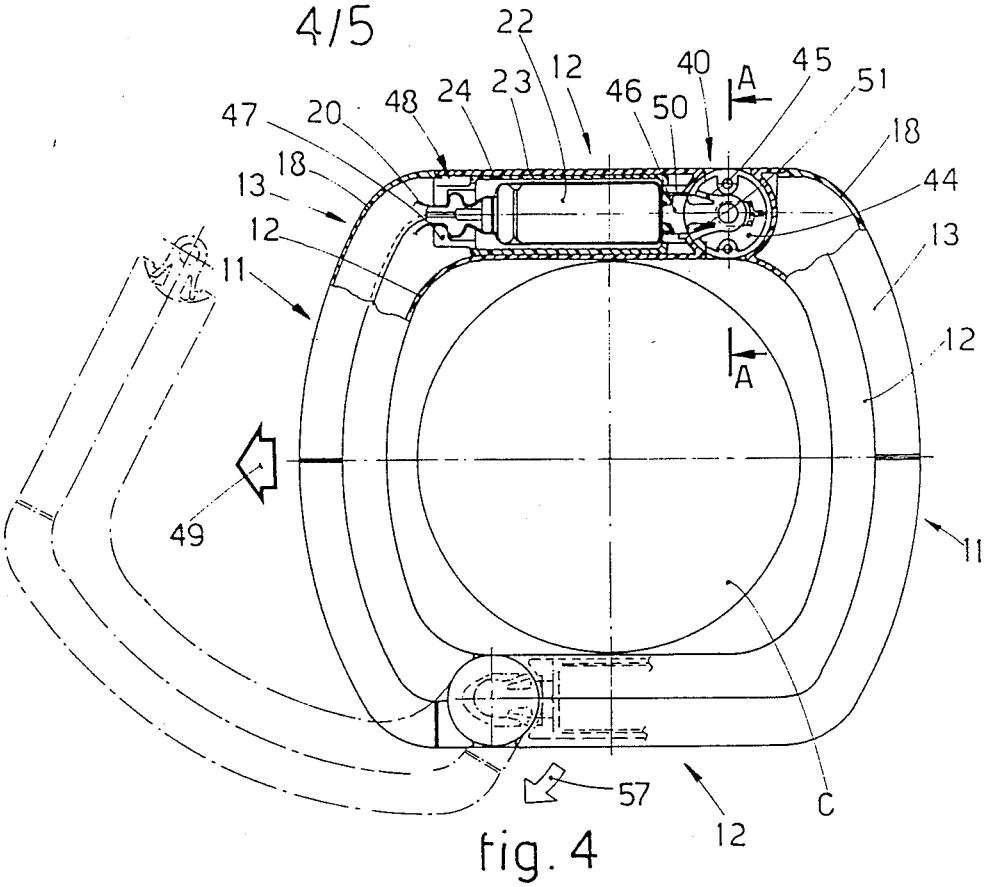
FIG. 4 shows a variant of the embodiment of FIG. 1.

Instead, in the example of FIG. 4 the two elements 11 can be separated at one selected mutual connection point and can be rotated on the other connection point in relation to each other.

Each element 11 has a substantially quadrangular or round section and comprises a container 12 for fluid and a container 13 for an expansible envelope 20.

In the example of FIG. 1 the container 12 for fluid comprises a ring nut 14 for opening purposes, the ring nut 14 having a bayonet-type connection for instance, so that when the ring nut 14 is rotated by a pre-set value, it is possible to detach a containment chamber 15 so as to check, inspect and replace a tank 22 holding a fluid under pressure.

The container 12 for fluid comprises also a clamping push button 16 which serves to clamp an anchorage tongue 17.

By acting on the clamping push button 16 it is possible to free the anchorage tongue 17 and thus to separate the two elements 11 and enable them to be placed about the neck of a user.

The container 13 for the expansible envelope 20 comprises a neck protector 21 which acts also as a stiffening, connecting and support structure.

The continuous side of the neck protector 21 faces inwards to safeguard the neck of the user of the collar 10 against any dangerous action of the expansible envelopes 20.

The neck protector 21 has a substantially U-shaped form and is secured rigidly to the container 12 for fluid by the opener ring nut 14 so as to form one element 11.

The neck protector 21 is also secured to the other element 11 by anchorage tongues 17 to form the collar 10.

The neck protector 21 may include at its front a chin protector 19 if the expansible envelope 20 consists, for instance, of two chambers as shown in FIG. 1.

The neck protector 21 is closed at its front by one or more protection covers 18, which are released automatically by the action of inflation of the expansible envelope 20 when inflated by the action of the gas under pressure.

Each protection cover 18 may consist of one or more pieces, which fit together lengthwise and, if so designed, open on inflation of the envelope 20 and widen the stiffened zone that rests against the neck of the user.

However, each cover 18 may also be of a throwaway type or may include connection means, for instance for connection to the neck protector 21, for recovery of the cover when it is dislodged from its seating.

The expansible envelope 20 may consist of one single chamber or of two or more chamber enlargements as shown in the example of FIG. 1.

Each expansible envelope 20 cooperates with its respective container 12 for fluid and is secured to its respective neck protector 21, in the example of FIG. 1, by means of a blind anchorage ring nut 29 and an anchorage ring nut 34 having a through hole, the anchorage ring nuts 29 and 34 being secured in turn by a clamping ring 30 and sleeve 35 respectively.

Besides being as described above, the expansible envelope 20 may be secured to the neck protector 21 at several points and in different ways.

Thus it is possible to provide an eyelet 53 that cooperates with a pin 56 inserted in the eyelet and fixed within the neck protector 21.

It is also possible to provide a slot 55 cooperating with a lodgement 52 made in the neck protector 21; in the lodgement is inserted a tooth 54, which opens apart and is solidly fixed to the expansible envelope 20.

The anchorage ring nut 34 having a through hole comprises advantageously a non-return valve 33.

In the example of FIG. 1 each specific container 12 for fluid has a containment chamber 15 with an outer protective shell 23, which also bears the anchorage tongues 17 and guides for the clamping push buttons 16.

The anchorage tongues 17 fix themselves to an abutment ring 38 included in the neck protector 21 of the other element 11.

The outer shell 23 cooperates with an inner casing 24, which comprises means for alignment with the neck protector 21 of the other element 11.

The inner casing 24 comprises also means to guide axially and to anchor a pin 27 of a bracket 26 that supports and positions the tank 22 of fluid under pressure.

This pin 27 may include expansible edges 28 which restrict its axial travel.

The bracket 26 can move axially within a sealed chamber 25 located within the inner casing 24.

The sealed chamber 25 cooperates with the opener ring nut 14, possibly by means of seal engagement rings 32, so as to secure the containment chamber 15 to the neck protector 21 of its own element 11.

The bracket 26 comprises at its upper end safety projections 39, which during axial movement of the bracket 26 are resisted by one or more ledges 31 that can be broken under a pre-set load. The purpose of this is to prevent wrong or undesired movements causing safety measures to be actuated.

The anchorage ring nut 34 with a through hole comprises a non-return valve 33.

When the ledges 31 have been broken and the bracket 26 can move axially, anchorage teeth 36 included in the bracket 26 itself can move and are retained in appropriate recesses 27 in the sealed chamber 25, thus preventing return of the bracket 26 and obviating interruption of delivery of fluid.

Figure 3:
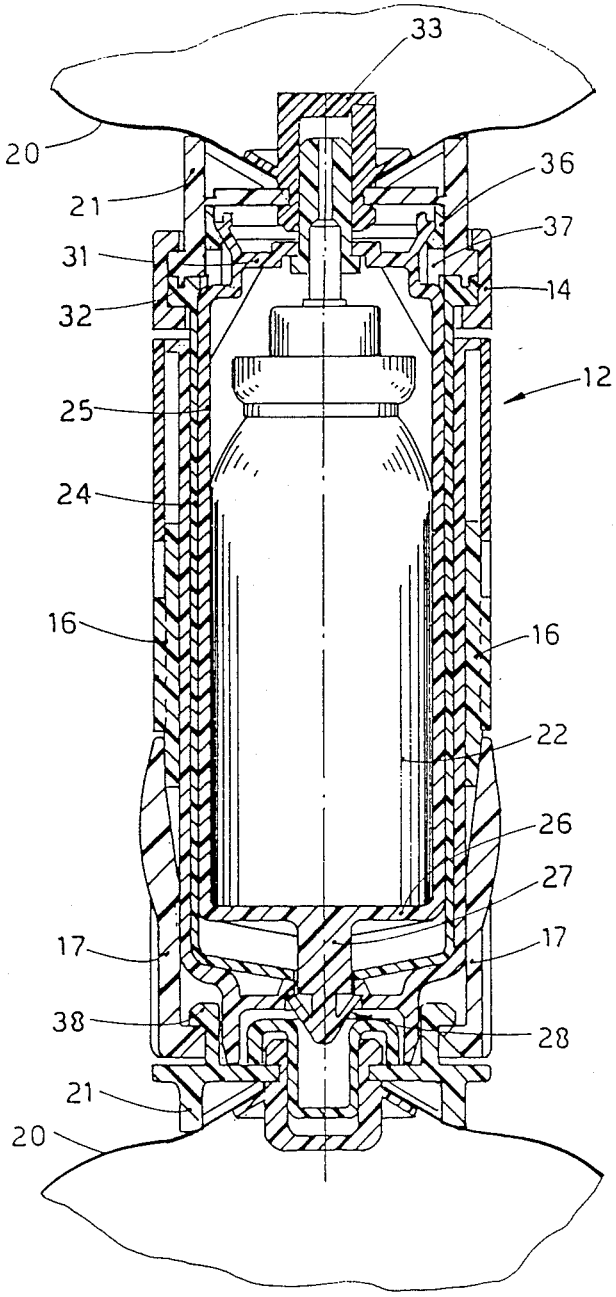
FIG. 3 shows a horizontal section, at a right angle to the section of FIG. 2, of the distribution means.

When the bracket 26 is in its inactive position (FIG. 3), the anchorage teeth 36 cooperate with an inverted tapered seating, which too assists in ensuring that wrong actions are not performed.

By opening the opener ring nut 14 it is possible to have access to the sealed chamber 25 and to remove the bracket 26 therefrom and change the fluid tank 22.

Figure 5:
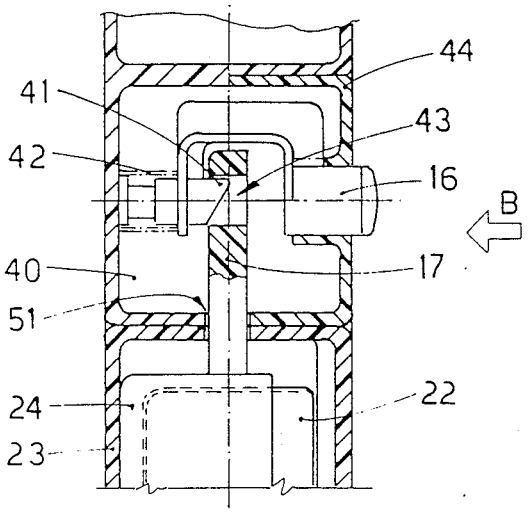
FIG. 5 shows a section along the line A—A of FIG. 4.
Figure 6:
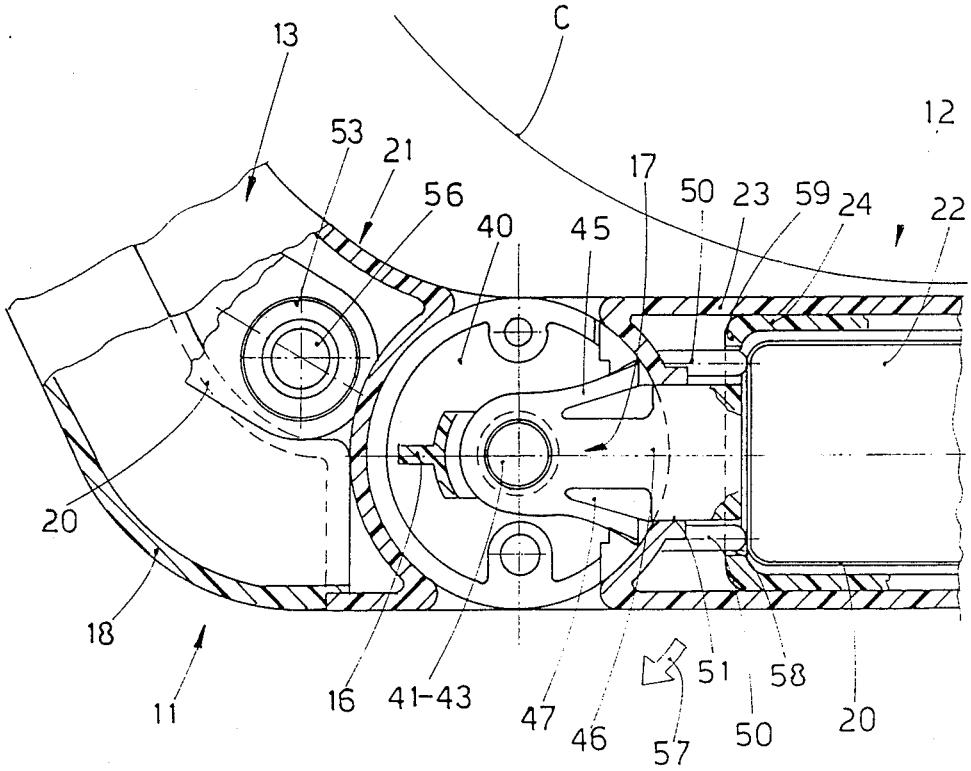
FIG. 6 shows the embodiment of FIG. 5 as seen in the direction of the arrow B.

FIGS. 4, 5 and 6 show a variant which enables the elements 11 to be rotated in relation to each other on the same plane so that they can be positioned on a user's neck.

Each element 11 comprises at one end an anchorage tongue 17 which cooperates with a lodgement 40 included at its other end, where the clamping push button 16 is located that cooperates, by means of a tooth 41 and resilient resistance means 42, with a hole 43 present in the anchorage tongue 17. A removable plug 44 makes possible access to the lodgement 40.

By acting on the clamping push button 16 it is possible to free the anchorage tongue 17 and rotate the elements 11 about the other tooth 41.

The anchorage tongue 17 is integrally fixed to the inner casing 24 which contains the tank 22 holding fluid under pressure.

Anchorage of the anchorage tongue 17 to the outer shell 23 is obtained by insertion into a hole 51 included in the outer shell 23 and by subsequent expansion of resilient projections 45 included at the sides of the anchorage tongue 17.

A body 46 of the anchorage tongue 17 can slide in the hole 51, and this axial sliding is resisted by pins 50 which act at one end against the outer shell 23 and at the other end against the rear part of the tank 22 through appropriate holes 58 included in the generating end 59 of the anchorage tongue 17.

It is possible to include resilient means 50 instead of the pins 50, the resilient means 50 having the same task of thrusting against the tank 22. The pins 50 act on the tank 22 through appropriate holes 58 in the inner casing 24.

The tank 22 can slide within the inner casing 24, and the inner casing 24 can slide within the outer shell 23.

The inner casing 24 comprises a terminal head 47 that serves to anchor a delivery nozzle 48 of the tank 22, the delivery nozzle 48 being enfolded with a seal engagement, as also is the head of the tank 22, by the terminal part of the expansible envelope 20.

According to a variant the expansible envelope 20 (see FIGS. 4 and 6) enfolds the tank 22 completely and closes it in a watertight environment. This ensures full employment of the fluid in the tank 22 without any chance of leakages.

Anchorage of the expansible envelope to the neck protector 21 can be obtained with one or more of the systems described for the embodiment of FIG. 1.

When the front element 11 is pulled in the direction of the arrow 49, the rear element 11 is rested on the back of the neck "C" and the outer shell 23 slides on the inner casing 24 and the body 46 and presses by means of the pins 50 on the rear of the tank 22.

The tank 22 presses the delivery nozzle 48 against the terminal head 47, which is retained by the rear element 11 through the inner casing 24 and anchorage tongue 17.

The delivery nozzle 48, being pressed towards the tank 22, opens the valve and releases into the expansible envelope 20 the fluid under pressure in the tank 22.

For replacement of the tank 22, action is exerted on the resilient projections 45; the inner casing 24 with the tank 22 and expansible envelope 20 is then extracted (the cover 18 being absent) from the front.

The life preserver collar according to the invention can be equipped with adapters so that it can be suited to the size of the user's neck.

I claim:

1. Life preserver collar for use in preventing drowning and to be worn by an individual around the neck, comprising means to deliver fluid under pressure to an expansible envelope means having two identical elements which are separable from each other at a reciprocal joint, wherein each identical element comprises a container of an expansible envelope and a container of fluid, and wherein the container of an expansible envelope comprises a neck protector which acts as a connecting, protecting and containing structure and at least one outer protective cover capable of being opened by expansion of the expansible envelope means which is contained and anchored in its limp, inactive state within the container of an expansible envelope.

2. The life preserver collar of claim 1, wherein the container of fluid comprises a ring nut for opening the container of fluid.

3. Collar as claimed in claim 2, in which a casing defining a sealed chamber cooperates with the ring nut and is included within the outer shell.

4. Collar as claimed in claim 1, in which the container of the expansible envelope comprises a chin protector.

5. The life preserver collar of claim 1, wherein the expansible envelope and the fluid container are reciprocally anchored by male and female connection means.

6. Collar as claimed in claim 1, in which the expansible envelope includes at least one chamber.

7. Collar as claimed in claim 1, in which the neck protector and expansible envelope are secured to each other by an eyelet and pin.

8. Collar as claimed in claim 1, in which the container of fluid comprises anchorage tongues for anchorage of an abutment ring included in the neck protector of the other identical element.

9. Collar as claimed in claim 1, in which the neck protector and expansible envelope are secured to each other by anchorage ring nuts and clamping means.

10. Life preserver collar for use in preventing drowning and to be worn by an individual around the neck, comprising means to deliver fluid under pressure to an expansible envelope means having two identical elements which are separable from each other at a reciprocal joint, wherein each identical element comprises a container of an expansible envelope and a container of fluid, and wherein the container of fluid comprises at least one outer shell and one inner casing which are substantially concentric, and a tank of fluid under pressure located within and substantially coaxial with the inner casing.

11. Collar as claimed in claim 10, in which the inner casing is able to move in relation to the outer shell and bears an anchorage tongue with a hole, resilient projections and a body, the body cooperating with a hole included at the end of the outer shell.

12. Collar as claimed in claim 11, further comprising a clamping push button with resilient resistance means and a clamping tooth cooperating with the hole in the anchorage tongue to orient the other identical element.

13. Collar as claimed in claim 11, in which the inner casing comprises a terminal head for anchorage of a delivery nozzle, the delivery nozzle and at least a terminal part of the tank being enfolded with an engagement seal by a terminal inlet of the expansible envelope.

14. Collar as claimed in claim 10, in which the inner casing comprises pins cooperating with the bottom of the tank through holes included at an end of the inner casing.

15. Collar as claimed in claim 10, in which the inner casing comprises guide means for alignment with the neck protector of the other identical element.

16. Collar as claimed in claim 10, in which the outer shell cooperates with the inner casing having means for axially guiding a pin of a bracket that bears the tank under pressure.

17. Collar as claimed in claim 16, in which the bracket is hindered axially in its movement by ledges which can be broken with a pre-set load.

18. Collar as claimed in claim 16, in which the bracket is held in a position of delivery of fluid under pressure by anchorage teeth cooperating with anchorage recesses.

19. Collar as claimed in claim 16, in which the pin of the bracket comprises expansible edges able to restrict its extraction travel.

20. Collar as claimed in claim 10, in which the tank of fluid under pressure cooperates with a non-return valve.

21. Collar as claimed in claim 10, in which the tank of fluid under pressure is anchored within the inner casing.

* * * * *